US011959215B2

(12) United States Patent
Moro et al.

(10) Patent No.: US 11,959,215 B2
(45) Date of Patent: Apr. 16, 2024

(54) WASH ARTICLE ENTRAPMENT DETECTION FOR LAUNDRY WASHING MACHINES

(71) Applicant: Electrolux Home Products, Inc., Charlotte, NC (US)

(72) Inventors: Alberto Moro, Porcia (IT); Andrea Franceschetti, Porcia (IT); Fabio Altinier, Porcia (IT); Daniele Beninato, Porcia (IT)

(73) Assignee: Electrolux Home Products, Inc., Charlotte, NC (US)

( * ) Notice: Subject to any disclaimer, the term of this patent is extended or adjusted under 35 U.S.C. 154(b) by 537 days.

(21) Appl. No.: 17/237,554

(22) Filed: Apr. 22, 2021

(65) Prior Publication Data

US 2022/0341077 A1 Oct. 27, 2022

(51) Int. Cl.
*D06F 33/47* (2020.01)
*D06F 34/14* (2020.01)
(Continued)

(52) U.S. Cl.
CPC ..... *D06F 33/47* (2020.02); *D06F 34/14* (2020.02); *D06F 2103/02* (2020.02); *D06F 2103/24* (2020.02)

(58) Field of Classification Search
CPC ..... D06F 33/47; D06F 34/14; D06F 2103/02; D06F 2103/24; D06F 33/32;
(Continued)

(56) References Cited

U.S. PATENT DOCUMENTS 4,765,161 A 8/1988 Williamson
5,293,760 A 3/1994 Tani et al.
(Continued)

FOREIGN PATENT DOCUMENTS

EP 1500738 A1 1/2005
EP 2607537 A1 6/2013
(Continued)

OTHER PUBLICATIONS

DE 102018208242 A1 translation, Method for Detecting Trapped Laundry in a Laundry Treatment Appliance and Suitable Laundry Treatment Appliance, ALBAYRAK (Year: 2019).*
(Continued)

*Primary Examiner* — Cristi J Tate-Sims
(74) *Attorney, Agent, or Firm* — Bradley Arant Boult Cummings LLP

(57) ABSTRACT

A method for detecting entrapment of an article within a laundry washing machine. The method includes rotating the drum to a target rotation speed, determining a respective drum motor torque value for each rotation, determining a distribution characteristic value of the drum motor torque values, comparing the distribution characteristic value to a predetermined threshold value, performing a correction operation to address an entrapment condition upon determining that the distribution characteristic value is above the predetermined threshold value, and proceeding with the laundry washing cycle upon determining that the distribution characteristic value is below the predetermined threshold value.

23 Claims, 5 Drawing Sheets

(51) Int. Cl.
*D06F 103/02* (2020.01)
*D06F 103/24* (2020.01)

(58) Field of Classification Search
CPC .. D06F 2105/52; D06F 2105/62; D06F 23/02; D06F 2103/46
See application file for complete search history.

(56) References Cited

U.S. PATENT DOCUMENTS

| | | | |
|---|---|---|---|
| 5,339,474 | A | 8/1994 | Kim et al. |
| 5,713,221 | A | 2/1998 | Myers et al. |
| 6,029,300 | A | 2/2000 | Kawaguchi et al. |
| 6,047,428 | A | 4/2000 | Min |
| 6,241,782 | B1 | 6/2001 | Haar |
| 6,282,965 | B1 | 9/2001 | French et al. |
| 6,381,791 | B1 | 5/2002 | French et al. |
| 6,393,918 | B2 | 5/2002 | French et al. |
| 6,401,284 | B1 | 6/2002 | Jeon et al. |
| 6,418,758 | B1 | 7/2002 | Ikeda et al. |
| 6,530,100 | B2 | 3/2003 | Conrath |
| 6,578,225 | B2 | 6/2003 | Jonsson |
| 6,594,841 | B2 | 7/2003 | Broker et al. |
| 6,615,619 | B2 | 9/2003 | Kakuda et al. |
| 6,640,372 | B2 | 11/2003 | Ciancimino et al. |
| 6,715,175 | B2 | 4/2004 | Ciancimino et al. |
| 7,401,480 | B2 | 7/2008 | Poehler |
| 7,571,506 | B2 | 8/2009 | Poehler |
| 7,739,765 | B2 | 6/2010 | Ashrafzadeh et al. |
| 7,950,255 | B2 | 5/2011 | Ashrafzadeh et al. |
| 8,122,549 | B2 | 2/2012 | Park et al. |
| 8,631,527 | B2 | 1/2014 | Ashrafzadeh et al. |
| 8,875,332 | B2 | 11/2014 | Janke et al. |
| 9,080,277 | B2 | 7/2015 | Erickson et al. |
| 9,157,177 | B2 | 10/2015 | Buendia et al. |
| 9,200,400 | B2 | 12/2015 | Janke et al. |
| 9,765,463 | B2 | 9/2017 | Ashrafzadeh et al. |
| 9,822,476 | B2 | 11/2017 | Janke et al. |
| 9,890,490 | B2 | 2/2018 | Janke et al. |
| 9,957,653 | B2 | 5/2018 | Ashrafzadeh et al. |
| 10,273,621 | B2 | 4/2019 | Borlin et al. |
| 10,669,663 | B2 | 6/2020 | Borlin et al. |
| 2003/0145392 | A1 | 8/2003 | Hird |
| 2005/0102766 | A1 | 5/2005 | Haar et al. |
| 2008/0109967 | A1 | 5/2008 | Ashrafzadeh et al. |
| 2008/0120789 | A1 | 5/2008 | Ashrafzadeh et al. |
| 2011/0016738 | A1* | 1/2011 | Ashrafzadeh ..... D06F 33/32 68/12.02 |

FOREIGN PATENT DOCUMENTS

| | | | |
|---|---|---|---|
| JP | 11333187 | A | 7/1999 |
| WO | 2018007146 | A1 | 1/2018 |
| WO | 2018228804 | A1 | 12/2018 |
| WO | 2020060269 | A1 | 3/2020 |

OTHER PUBLICATIONS

International Search Report and Written Opinion for International Application No. PCT/US2022/023254, dated Jul. 22, 2022, 14 pages.

International Search Report and Written Opinion for International Application No. PCT/US2022/023242, dated Jul. 29. 2022, 13 pages.

* cited by examiner

WASH ARTICLE ENTRAPMENT DETECTION FOR LAUNDRY WASHING MACHINES

TECHNICAL FIELD

The present invention relates to the field of laundry washing machine operating condition detection, and particularly to detecting the presence of an article trapped between the drum door and bellows seal.

BACKGROUND

Laundry washing machines ("washers") are in common use. Such machines may be configured as a dedicated washer that is configured solely to wash or clean the laundry, or as a combination washer/dryer that also has active laundry drying features (e.g., a heat pump, gas heater, or electric heater in combination with a forced air system). Other configurations also may be possible (e.g., a washer with multiple separate wash compartments, etc.). As used herein, the terms "washer" and "washing machine" are intended to include all such variations.

Washers include a tub to hold wash liquid, and a drum that is configured to rotate within the tub. In many cases, the tub and drum are oriented in use with the drum configured to rotate about a horizontal axis (i.e., angled less than 45° relative to the 90° vertical gravitational direction, and typically much closer to 0° degrees). In such washers, access to the drum may be provided via a door located along the rotation axis, and a bellows seal (or simply "bellows") may be provided to seal the door to the tub, to prevent wash liquid from escaping around the door during operation.

A problem with washers having a door and bellows arrangement is that wash articles, such as clothing, linens, extraneous articles (e.g., balls, lighters, keys and so on that might be introduced with clothing) and the like, can become trapped between the door and the bellows. Such entrapment can occur at the time the door is closed, or during operation if the wash articles are pressed between the door and bellows. If the user does not detect and correct the entrapment, rotation of the drum can create forces on the article that can damage the bellows and the article. Such damage typically occurs late in the washing cycle, when the drum is rotated at high speed to extract water in preparation for subsequent active drying. This damage can include tearing the article, removing portions of the bellows, partially removing portions of the bellows from engagement with the door or tub, and even complete separation of the bellows from the tub and door. Such damage can lead to undesirable washing results, temporary or permanent water leaks, and repair or replacement costs.

A conventional washing cycle begins with relatively slow drum movement (tumbling or back-and-forth motions) during the initial water loading and washing phases, and concludes with a high-speed spinning phase to extract water from the laundry. Some washers are configured to perform initial low-speed phases to evaluate the condition of the laundry articles. For example, the drum may be rotated to perform inertia pre-estimation, load distribution evaluation and correction, and for other purposes. It has been found to be difficult to detect entrapped articles during the initial load evaluation stages, and attempts to detect entrapped articles typically are performed during a high-speed dynamic imbalance measurement phase that is performed prior to or during a high-speed spin drying phase. At this point, entrapped articles experience forces that can cause damage (damage prior to this phase is possible, but less likely). Thus, damage may already occur by the time the entrapment is detected.

The inventors have determined that it would be desirable to detect article entrapment at the beginning of the wash cycle and prior to beginning a high-speed spinning phase such as an imbalance measurement phase or a spin drying phase.

This description of the background is provided to assist with an understanding of the following explanations of exemplary embodiments, and is not an admission that any or all of this background information is necessarily prior art.

SUMMARY

In a first aspect, there is provided a method for detecting entrapment of a wash article within a laundry washing machine comprising a tub configured to hold a quantity of wash liquid, a drum rotatably mounted within the tub and configured to hold a quantity of wash articles, a door movable between an open position and a closed position, a bellows seal configured to seal the door to the tub when the door is in the closed position, and a drum motor configured to rotate the drum. The method comprises: receiving an instruction to begin a laundry washing cycle; operating the drum motor to accelerate the drum to a target rotation speed; and upon reaching the target rotation speed, performing a first entrapment determination process comprising: performing a first plurality of rotations at the target rotation speed, determining at least one respective drum motor torque value for each of the first plurality of rotations, determining at least one first distribution characteristic value of the drum motor torque values of the first plurality of rotations, comparing the at least one first distribution characteristic value of the drum motor torque values of the first plurality of rotations to a respective first predetermined threshold value, upon determining that the at least one first distribution characteristic value of the drum motor torque values of the first plurality of rotations is above the respective first predetermined threshold value, performing a correction operation to address an entrapment condition, and upon determining that each at least one first distribution characteristic value of the drum motor torque values of the first plurality of rotations is below the respective first predetermined threshold value, proceeding with the laundry washing cycle.

In some aspects, the target rotation speed comprises a speed selected to cause satellization of wash articles within the drum.

In some aspects, the target rotation speed is equal to or greater than 100 rotations per minute.

In some aspects, the first plurality of rotations comprises at least ten rotations.

In some aspects, each respective drum motor torque value comprises at least one respective extremum drum motor torque value.

In some aspects, the at least one respective extremum drum motor torque value comprises a respective maximum motor torque value.

In some aspects, the at least one respective extremum drum motor torque value comprises a respective minimum motor torque value.

In some aspects: the at least one respective extremum drum motor torque value comprises a respective maximum motor torque value and a respective minimum motor torque value; determining the at least one first distribution characteristic value of the extremum torque values of the first plurality of rotations comprises determining a single first distribution characteristic value selected as a greater of: a maximum torque distribution characteristic value of the respective maximum motor torque values of the first plurality of rotations, and a minimum torque distribution characteristic value of the respective minimum motor torque values of the first plurality of rotations; and comparing the at least one first distribution characteristic value of the extremum torque values to the respective first predetermined threshold value comprises comparing the single first distribution characteristic value to a single first predetermined threshold value.

In some aspects: the at least one respective extremum drum motor torque value comprises a respective maximum motor torque value and a respective minimum motor torque value; determining the at least one first distribution characteristic value of the extremum torque values of the first plurality of rotations comprises determining a maximum torque distribution characteristic value of the respective maximum motor torque values, and determining a minimum torque distribution characteristic value of the respective minimum motor torque values; comparing the at least one first distribution characteristic value of the extremum torque values of the first plurality of rotations to the respective first predetermined threshold value comprises comparing the maximum torque distribution characteristic value to a predetermined maximum torque distribution characteristic threshold value, and comparing the minimum torque distribution characteristic value to a predetermined minimum torque distribution characteristic threshold value; determining that the at least one first distribution characteristic value of the extremum torque values of the first plurality of rotations is above the respective first predetermined threshold value comprises determining that one or both of the maximum torque distribution characteristic value is above the predetermined maximum torque distribution characteristic threshold value, and the minimum torque distribution characteristic value is above the predetermined minimum torque distribution characteristic threshold value; and determining that the at least one first distribution characteristic value of the extremum torque values of the first plurality of rotations is below the respective first predetermined threshold value comprises determining that the maximum torque distribution characteristic value is below the predetermined maximum torque distribution characteristic threshold value, and the minimum torque distribution characteristic value is below the predetermined minimum torque distribution characteristic threshold value.

In some aspects, performing the correction operation to address the entrapment condition comprises operating the drum motor to stop rotation of the drum.

In some aspects, performing the correction operation to address the entrapment condition comprises: operating the drum motor to slow the drum below the target rotation speed; operating the drum motor to accelerate the drum from below the target rotation speed to the target rotation speed; and upon reaching the target rotation speed, performing a second entrapment determination process comprising: performing a second plurality of rotations at the target rotation speed, determining at least one respective drum motor torque value for each of the second plurality of rotations, determining at least one second distribution characteristic value of the drum motor torque values of the second plurality of rotations, comparing the at least one second distribution characteristic value of the drum motor torque values of the second plurality of rotations to a respective second predetermined threshold value, upon determining that the at least one second distribution characteristic value of the drum motor torque values of the second plurality of rotations is above the respective second predetermined threshold value, performing a further correction operation, and upon determining that each at least one second distribution characteristic value of the drum motor torque values of the second plurality of rotations is below the respective second predetermined threshold value, proceeding with the laundry washing cycle.

In some aspects, the respective second predetermined threshold value is different from the first respective predetermined value.

In some aspects, the method further comprises: estimating a mass of the quantity of wash articles; and determining the first predetermined threshold value as a function of the estimated mass of the quantity of wash articles.

In some aspects, the at least one first distribution characteristic value comprises a variance value, and determining the at least one first variance value of the respective drum motor torque values of the first plurality of rotations comprises: determining a mean value of the respective drum motor torque values of the first plurality of rotations; determining a respective difference between each respective drum motor torque value of the first plurality of rotations and the mean value; squaring the value of each respective difference between each respective drum motor torque value of the first plurality of rotations and the mean value; and averaging a sum of the squared value of each respective difference between each respective drum motor torque value of the first plurality of rotations and the mean value to establish the at least one first variance value.

In some aspects, the at least one first distribution characteristic value comprises one or more of: a standard deviation value; a range value; an interquartile range value; and a confidence interval.

In some aspects, proceeding with the laundry washing cycle comprises performing a washing phase followed by a high-speed spinning phase.

In some aspects, operating the drum motor to accelerate the drum to the target rotation speed comprises operating the drum motor to accelerate the drum from a stopped state to the target rotation speed.

In another exemplary aspect, there is provided a method for detecting entrapment of a wash article within a laundry washing machine comprising a tub configured to hold a quantity of wash liquid, a drum rotatably mounted within the tub and configured to hold a quantity of wash articles, a door movable between an open position and a closed position, a bellows seal configured to seal the door to the tub when the door is in the closed position, and a drum motor configured to rotate the drum, the method comprising: receiving an instruction to begin a laundry washing cycle; operating the drum motor to accelerate the drum to a target rotation speed; and upon reaching the target rotation speed, performing a first entrapment determination process comprising: performing a first plurality of rotations at the target rotation speed, determining a respective maximum motor torque value and a respective minimum motor torque value for each of the first plurality of rotations, determining at maximum torque distribution characteristic value of the respective maximum torque values of the first plurality of rotations, determining at minimum torque distribution characteristic value of the respective minimum torque values of the first plurality of rotations, comparing a greater of the maximum torque distribution characteristic value and the minimum torque distribution characteristic value to a first predetermined threshold value, upon determining that the greater of the maximum torque distribution characteristic value and the minimum torque distribution characteristic value is above the first predetermined threshold value, performing a correction operation to address an entrapment condition, and upon determining that the greater of the maximum torque distribution characteristic value and the minimum torque distribution characteristic value is below the first predetermined threshold value, proceeding with the laundry washing cycle.

In some aspects, performing the correction operation to address the entrapment condition comprises: performing a second plurality of rotations at the target rotation speed, determining a respective maximum motor torque value and a respective minimum motor torque value for each of the second plurality of rotations, determining at maximum torque distribution characteristic value of the respective maximum torque values of the second plurality of rotations, determining at minimum torque distribution characteristic value of the respective minimum torque values of the second plurality of rotations, comparing a greater of the maximum torque distribution characteristic value and the minimum torque distribution characteristic value to a second predetermined threshold value, upon determining that the greater of the maximum torque distribution characteristic value and the minimum torque distribution characteristic value is above the second predetermined threshold value, performing a further correction operation, and upon determining that the greater of the maximum torque distribution characteristic value and the minimum torque distribution characteristic value is below the second predetermined threshold value, proceeding with the laundry washing cycle.

In some aspects, the second predetermined threshold value is the same as the first predetermined threshold value.

In some aspects, the second predetermined threshold is different from the first predetermined threshold.

In some aspects, the further correction operation comprises one or both of: operating the drum motor to stop rotation of the drum and displaying an error message on a user interface.

In some aspects, the further correction operation comprises: performing a third plurality of rotations at the target rotation speed, determining a respective maximum motor torque value and a respective minimum motor torque value for each of the third plurality of rotations, determining at maximum torque distribution characteristic value of the respective maximum torque values of the third plurality of rotations, determining at minimum torque distribution characteristic value of the respective minimum torque values of the third plurality of rotations, comparing a greater of the maximum torque distribution characteristic value and the minimum torque distribution characteristic value to a third predetermined threshold value, upon determining that the greater of the maximum torque distribution characteristic value and the minimum torque distribution characteristic value is above the third predetermined threshold value, operating the drum motor to stop rotation of the drum and/or displaying an error message on a user interface, and upon determining that the greater of the maximum torque distribution characteristic value and the minimum torque distribution characteristic value is below the third predetermined threshold value, proceeding with the laundry washing cycle.

BRIEF DESCRIPTION OF THE DRAWINGS

Embodiments of inventions will now be described, strictly by way of example, with reference to the accompanying drawings, in which.

DESCRIPTION OF EXEMPLARY EMBODIMENTS

Figure 1:
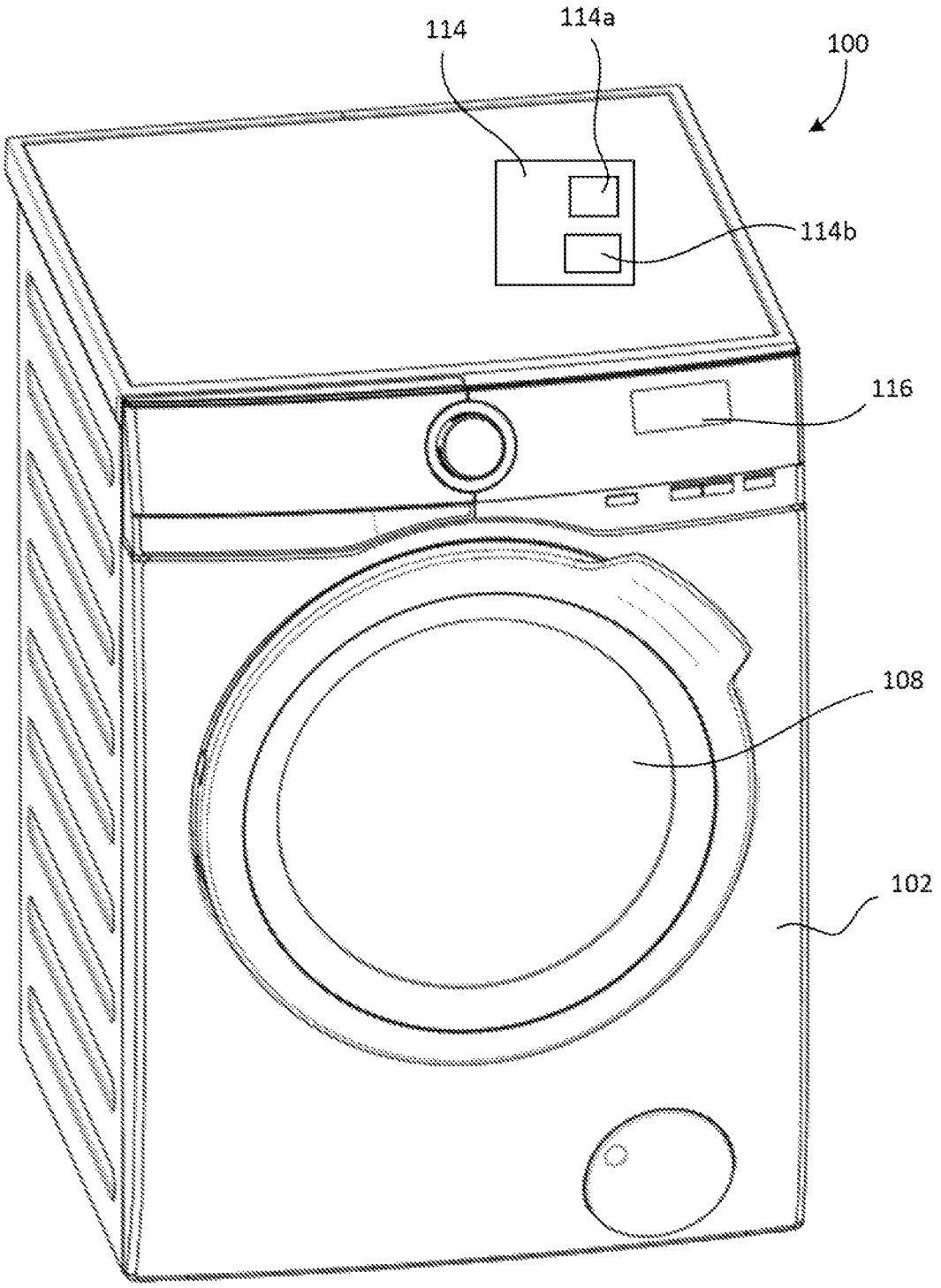
FIG. 1 illustrates an exemplary laundry washing machine according to embodiment herein.
Figure 2:
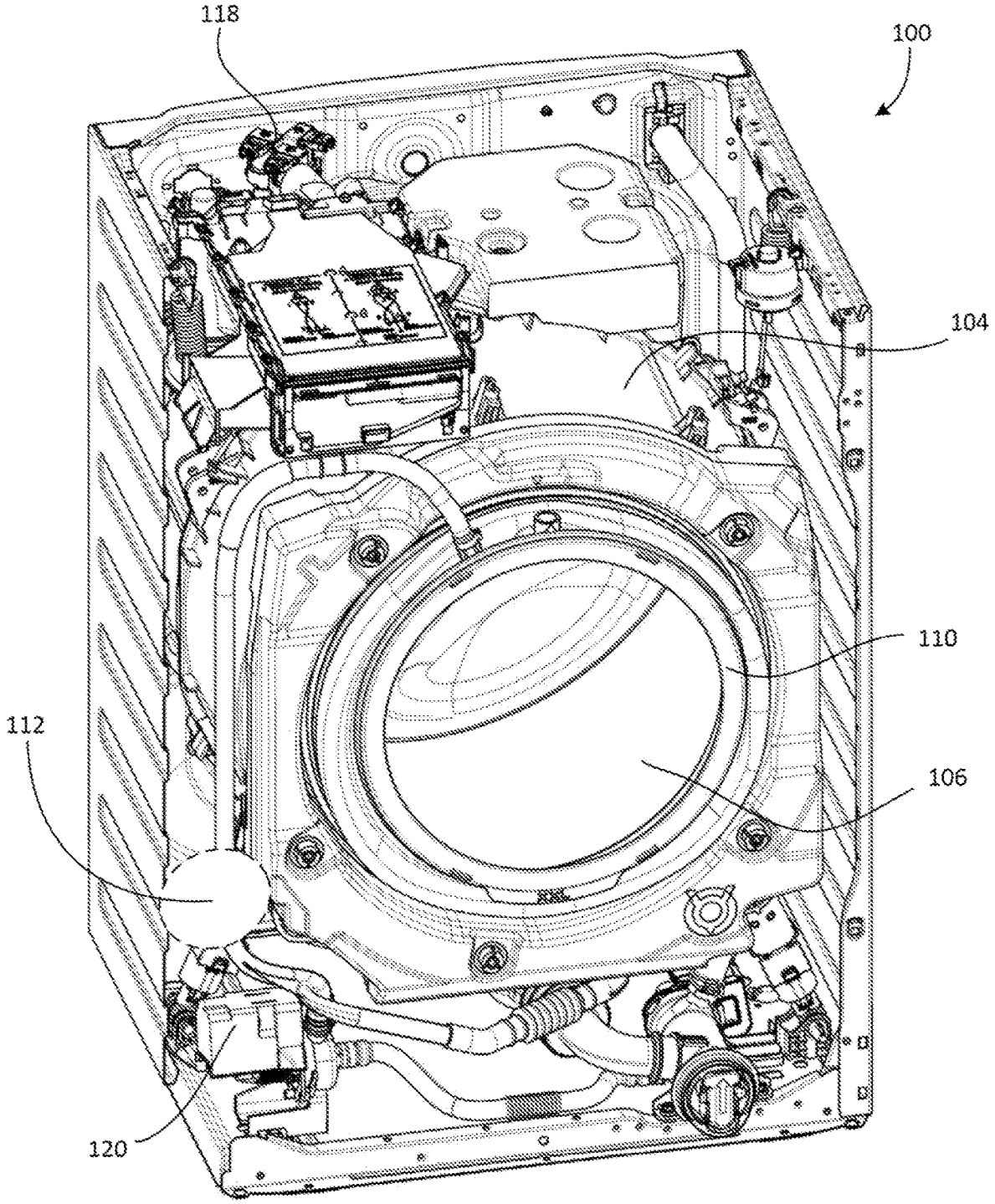
FIG. 2 illustrates the washing machine of FIG. 1 with the external casing removed.

FIGS. 1 and 2 illustrate an exemplary laundry washing machine 100 that may be configured to perform processes to detect entrapment of a wash article between the door and the bellows seal. The washing machine generally comprises a housing 102, a tub 104, a drum 106, a door 108, a bellows seal 110 ("bellows"), and a drum motor 112. The housing 102 is configured to stand on a horizontal surface and provide a structure to hold the remaining parts of the washing machine 100.

The tub 104 is suspended inside the housing 102 by a shock-absorbing system, and generally comprises water-impermeable walls with inlets and/or outlets leading to other parts of the fluid management system (pumps, drains, etc.) to thereby form a container for holding wash liquid (water, detergent, bleach, fabric softener, etc.). The drum 106 is mounted inside the tub 104 by a bearing assembly (not shown) that allows the drum 106 to rotate about a rotation axis. The drum 106 has a water-permeable wall to allow fluid transfer between the interior of the drum 106 and the surrounding tub 104. The drum 106 and tub 104 have aligned open ends, which are adjacent to an opening through the housing 102, to provide an access port for inserting and removing laundry articles into the drum 106. In this case, the drum 106 and tub 104 comprise generally cylindrical structures, and the drum 106 rotates about a generally horizontal axis (i.e., less than 45° relative to a horizontal surface upon which the machine 100 rests in use, and more preferably less than about 20° relative to such surface), but this is not strictly required.

The door 108 is attached to the housing 102 by a hinge or the like, to allow the door 108 to move (e.g., about a vertical pivot axis) between a closed position (FIG. 1) and an open position (not shown). The bellows 110 is connected to the open end of the tub 104, and to the opening through the housing 102, to provide a water-tight seal between the tub 104 and the housing 102. In the closed position, the door 108 presses against the bellows 110 to form a water-tight seal between the bellows 110 and the door 104. Thus, the door 108 closes and seals the access port to the drum 106. A latch (not shown) may be provided to hold the door 108 in the closed position.

A drum motor 112 (shown schematically) is mounted within the housing 102, and connected to the drum 106 via a drive shaft, gears, belts and pulleys, or the like, to thereby be configured to apply a drive torque to rotate the drum 106. The drum motor 112 may comprise any suitable electric motor, as known in the art.

The washing machine 100 includes a control unit 114 (shown schematically) comprising a processor **114*a* and a memory 114*b* that stores instructions in a non-volatile manner. The washing machine 100 also may include one or more sensors (e.g., water level, etc.). The washing machine 100 also has a user interface 116 having input devices (buttons, dials, switches, etc.) and output devices (lights, audio speakers, etc.). The user interface 116** may be extended wirelessly to a smart phone application or other remote control device via a wireless communications device (e.g., near field communication transceiver, infrared transceiver, wireless protocol transceiver, etc.). Details of processors, memories, user interfaces, and wireless communications with remote devices and applications are all known in the art, and need not be described in detail herein.

In use, the control unit 114 is operated to receive a user selection of an operation cycle from the user interface 116, and control the washing machine 100 to perform the selected operation cycle. Operation cycle instructions are stored in the memory 114*b*, and the processor 114*a* accesses the memory 114*b* to read the instructions, in a well-known manner. Each operation cycle may include, for example, a water filling phase in which valves 118 are operated to fill the tub 104 with wash liquid, an agitation phase in which the drum motor 112 is operated to spin or reciprocate the drum 106, a draining phase in which a pump 120 is operated to remove free liquid from the laundry articles, a rinsing phase, in which the valves 118 are operated to fill the tub 104 with fresh water, a second draining phase to remove free liquid form the laundry articles, and a high-speed spin stage in which the drum motor 112 is operated to spin the drum 106 at high speed to extract bound water from the laundry articles. The processor 114*a* carries out the instructions, using sensor feedback as may be indicated in the instructions, to operate the drum motor 112, as well as various other operative parts (e.g., valves 118, heaters, pumps 120, etc.).

The foregoing description provides just one example of a laundry washing machine 100 that may be used to implement methods described herein. Details of the structure and operation of such as laundry washing machine 100, as well as variations on such structures and operations, are well-known in the art, and need not be described in greater detail herein.

It has been determined that a washing machine 100, such as the one described above or otherwise, can be operated to detect a condition indicating the presence of an article trapped between the bellows 110 and the door 108 during an initial start-up phase of a washing cycle, using feedback from the drum motor 112. An example of such an entrapment detection algorithm is now described in relation to the illustration provided as FIG. 3.

The entrapment detection algorithm 300 ("the algorithm") begins at step 302 by receiving an instruction to begin a laundry washing cycle. The laundry washing cycle may be selected by the user at the user interface 116, and when selection is complete, the user may press a "start" button or the like. The start instruction also may be generated by a timer, remote control, or via other means, as known in the art.

Next, at step 304, the control unit 114 operates the drum motor 112 to accelerate the drum 106 to a target rotation speed St. The drum 106 may begin in a stopped state, or it may begin at any other rotation speed, preferably below the target rotation speed St. As explained in more detail below, the target rotation speed St is a speed that is expected to provide a regular repeating drive torque profile for the drum motor 112. In the embodiments described herein, the target rotation speed St is a speed selected to cause satellization of wash articles within the drum 106. The satellization speed is the speed at which the wash articles are pressed by centrifugal force against the wall of the drum 106 throughout the entire rotation of the drum. The satellization speed varies depending on drum size, and potentially other factors such as the angle of the drum rotation axis, but generally can be readily determined by conventional calculations as a speed sufficient to generate a centrifugal force that equals or exceeds the gravitational force at the top of the drum 106. In embodiments in which the drum rotation axis is vertical, it may not be strictly necessary to accelerate the drum 106 to a satellization speed or an equivalent thereof.

In preferred embodiments, the target rotation speed St is at least about 100 rotations per minute ("rpm"), which corresponds to the satellization speed for typical large-capacity horizontal-axis laundry washing machines as are common in the current U.S. market. In a more preferred embodiment, the target rotation speed St may exceed the typical satellization speed. In some embodiments, the target rotation speed St may equal 120 rpm. It will be understood that the target rotation speed St may be a specific rotation speed (e.g., 120 rpm), or it may be defined as a predetermined range such as 110-130 rpm (i.e., 120 rpm±10 rpm). Any particular specific speed will be understood to include operating variations as may be caused by or experienced using typical control algorithms.

At step 306, the control unit 114 monitors the drum rotation speed S to determine when it reaches the target rotation speed St. For example, the control unit 114 may monitor rotation speed by evaluating the periodicity of variations in the drum motor 112 drive torque or other operating variables (voltage, current, etc.) or by using a sensor such as an optical tachometer or hall-effect sensor, as known in the art. At this point, the control unit 114 may enter a feedback control loop to maintain the drum rotation speed S at or near the target rotation speed St until further instructions are given to modify the rotation speed (e.g., for the duration of some or all of the remaining steps illustrated in FIG. 3). If the drum rotation speed S varies from the target rotation speed St by a predetermined amount, the control unit 114 operates the drive motor 112 to accelerate or slow the drum 106, as needed to return to the target rotation speed St. Similarly, if the target rotation speed St includes a range, the control unit 114 may apply controls to the drum motor 112 when the actual rotation speed S reaches the end values of the range, to thereby maintain the rotation speed S within the target range. Standard proportional integral (PI) controls, or similar controls, may be used to control the drum rotation speed S, as known in the art. If the control unit 114 is unable to maintain the drum rotation speed S at the target rotation speed S, or within a range of acceptable speeds, the control unit 114 may terminate operation and display an error signal to the user at the user interface 116, or take other steps.

When the drum 106 reaches the target rotation speed St, the algorithm begins an entrapment determination process. At step 308, the control unit 114 operates the drum motor 112 to rotate the drum 106 for a first plurality of rotations R at the target rotation speed St. During each rotation R, the control unit 114 determines at least one value of the drum motor drive torque, as illustrated in step 310, and stores the respective value(s) in a memory 114*b*, as illustrated in step 312. For example, in a preferred embodiment, the control unit 114 determines and stores the two respective extremum values (i.e., a respective maximum motor torque value Tmax, and a respective minimum motor torque value Tmin) for each rotation R. This data collection continues for a predetermined number Rt of rotations R.

The drum motor drive torque value(s) may be monitored or calculated using any suitable technique, which may vary depending on the type of motor, the drive control system, and other factors. For example, instantaneous motor torque throughout a single drum rotation may be estimated by monitoring motor current, using known motor models and equations. As another example, a torque transducer may be incorporated into the motor drive system. Furthermore, where variations in drum motor torque may be estimated by evaluating an operating variable (e.g., fluctuations in current), the torque may be represented in a proportional sense by a measured current value. As will be apparent from the following, it is not strictly necessary to determine a unit value of the torque value; rather, a unitless proportional value may be used. Thus, for purposes of implementing embodiments herein, the "torque value" refers to any unit or unitless measurement or representation of drive torque, as may be indicated by a relevant variable (e.g., variations in measured current, variations in measured voltage representative of variations in measured current, etc.). Other alternatives and variations will be apparent to persons of ordinary skill in the art in view of the present disclosure, and such controls and torque determination methods are well-known in the art and need not be described in greater detail herein.

As shown in step 314, when the control unit 114 determines that the number of rotations R equals the predetermined number of rotations Rt, the algorithm 300 proceeds to step 316.

At step 316, the control unit determines a respective torque distribution characteristic value V for each measured set of drum motor torque values. In this case, the extremum values are considered, so the maximum torque values Tmax of the rotations R are collectively evaluated to provide a maximum torque distribution characteristic value Vmax, and the minimum torque values Tmin of the rotations R are collectively evaluated to provide a minimum torque distribution characteristic value Vmin.

In general terms, the distribution characteristic values Vmax, Vmin each represent a degree of dispersion of the respective torque values Tmax, Tmin. The distribution characteristic values Vmax, Vmin may be calculated using any suitable statistical model. For example, in one embodiment, the distribution characteristic value comprises a statistical variance value, and the maximum torque variance value Vmax and minimum torque variance value Vmin may be calculated using a conventional sample variance method by: (a) determining a mean value of the respective drum motor torque values; (b) determining a respective difference between each respective drum motor torque value and the mean value; (c) squaring the value of each respective difference; (d) and averaging a sum of the squared values. In the illustrated example, this process is performed separately for the maximum motor torque values Tmax and minimum torque motor values Tmin. This yields a maximum torque variance value Vmax representing dispersion of the maximum torque values Tmax of the sampled set of rotations R, and a separate minimum torque variance value Vmin representing dispersion of the minimum torque values Tmin of the sampled set of rotations R.

In other embodiments, the foregoing sample distribution characteristic method may be replaced by other methods for determining a distribution characteristic representative of the degree of dispersion of one or both of the determined torque values Tmax, Tmin. For example, the distribution characteristic may be a standard deviation value, a range value, an interquartile range value, a confidence interval value, and so on. Other alternatives and variations will be apparent to persons of ordinary skill in the art in view of the present disclosure. For purposes of the remaining description, the distribution characteristic is described, solely by way of example, as a variance value.

Upon determining the variance values Vmax, Vmin, the algorithm 300 continues to step 318, where the greater of the variance values Vmax and Vmin is compared to a predetermined threshold variance value Vt. As explained in more detail below, the predetermined threshold variance value Vt is selected to represent a degree of variance that indicates the possibility that a wash article is trapped between the bellows 110 and the door 108. If the greater of Vmax and Vmin is less than the predetermined threshold variance value Vt, the algorithm 300 moves to step 320 to perform the remainder of the washing cycle. If the greater of Vmax and Vmin is equal to or greater than the predetermined threshold variance value Vt, the algorithm 300 moves to a correction operation in step 322, to address the detected entrapment condition.

Figure 4:
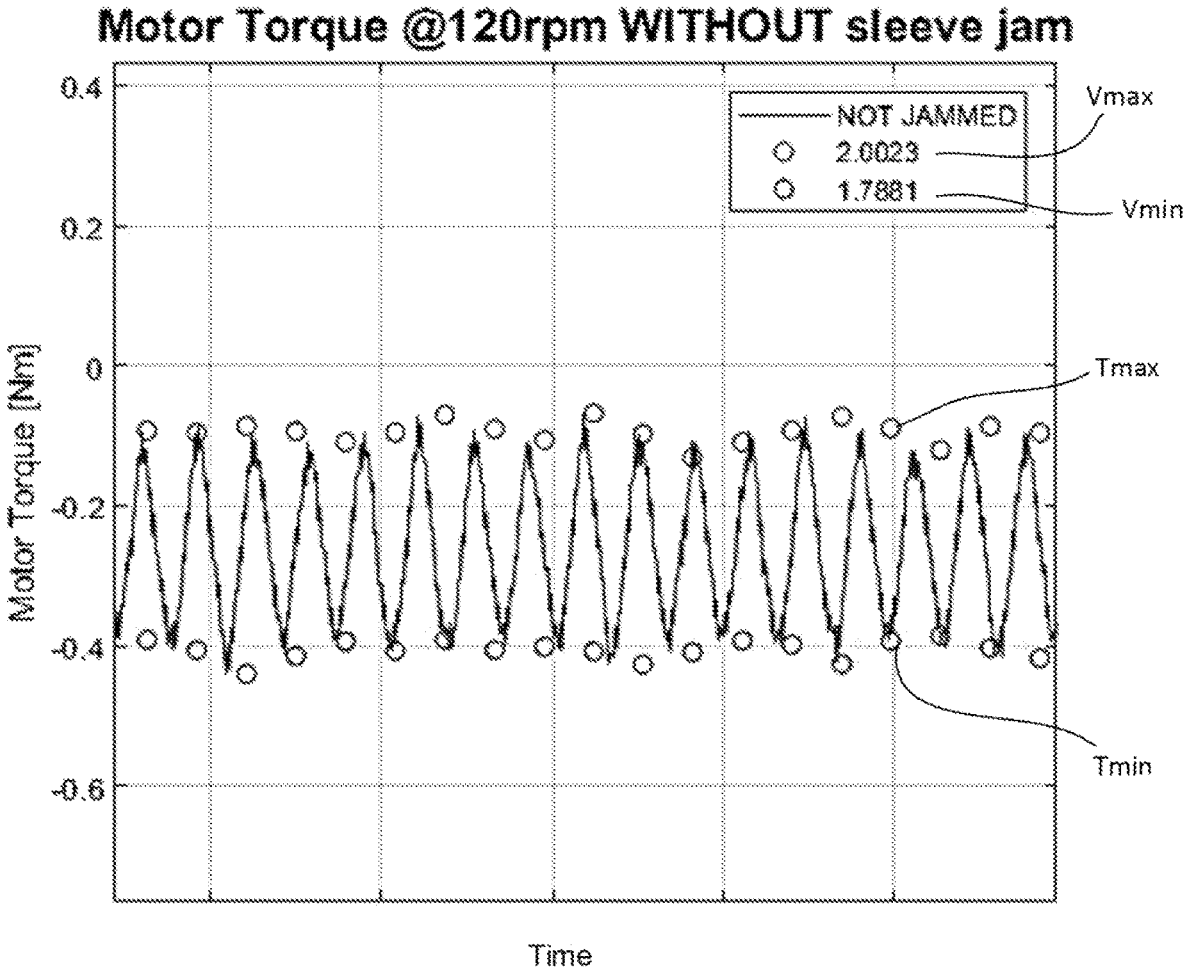
FIG. 4 illustrates an exemplary drum motor torque plot in a normal operating state.
Figure 5:
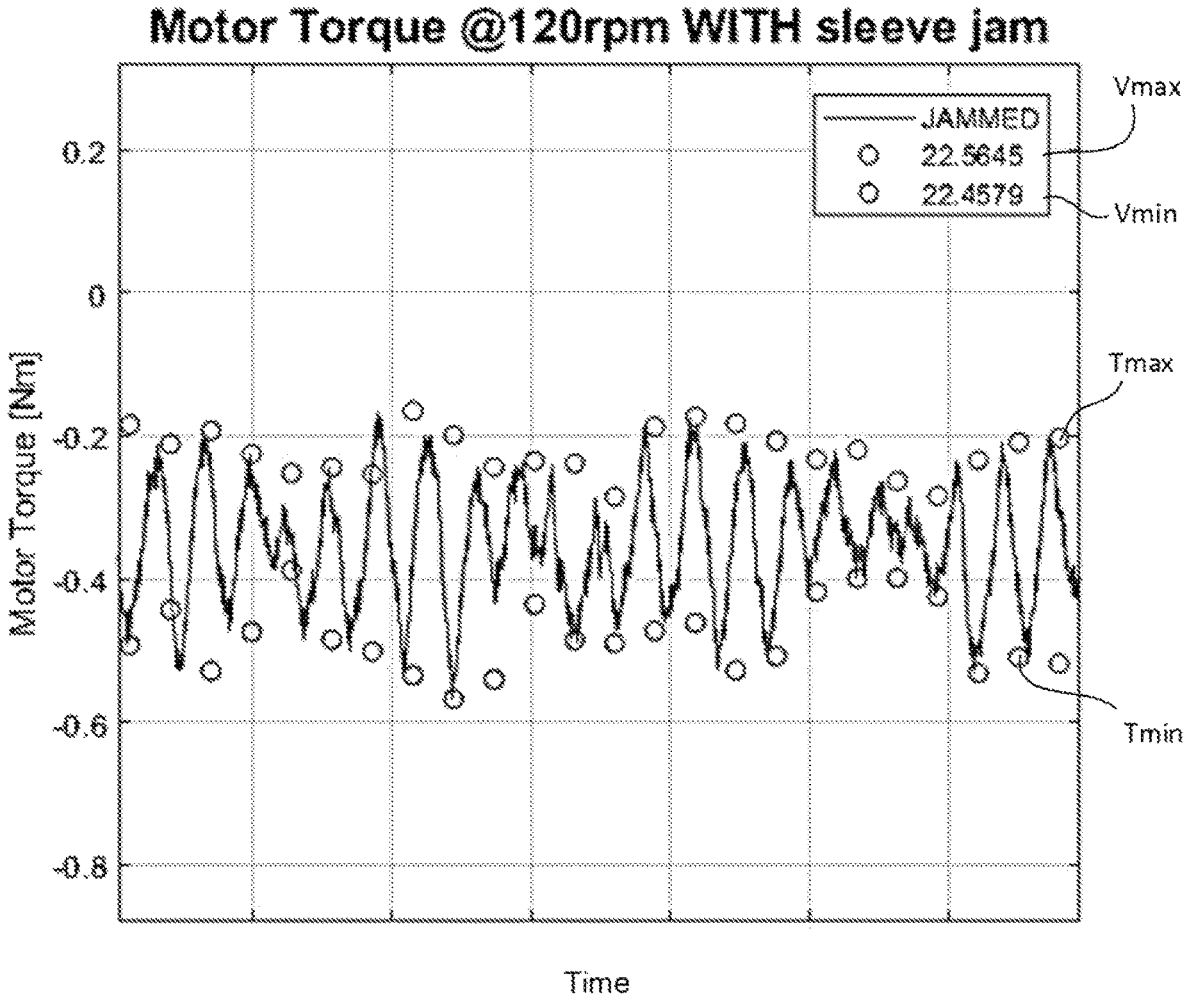
FIG. 5 illustrates an exemplary drum motor torque plot in an article entrapment state.

Referring now to FIGS. 4 and 5, the predetermined threshold variance value Vt may be determined via empirical testing, based on comparing examples of normal operation to examples of operation with an entrapment condition.

In normal operating conditions (i.e., when there are no articles trapped between the door 108 and the bellows 110), the laundry is completely attached to the drum 106 by centrifugal force when the drum 106 rotated at or above the satellization speed (typically 100 rpm or above). Thus, the laundry articles do not change positions, and the drive torque of the drum motor 112 is expected to have a repeating periodic waveform. Such waveform varies between maximum and minimum torque values with relatively little variation in magnitude from one rotation to the next.

An exemplary torque motor current waveform for normal operation is shown in FIG. 4, which shows motor torque magnitude varying over time in an approximately sinusoidal manner. The torque variation may be caused by a number of different factors, such as uneven distribution of laundry articles around the perimeter of the drum 106. During normal operation, a periodical drum motor torque waveform is typical during every rotation of the drum 106. During such normal operation, the maximum torque values Tmax of each waveform (i.e., each rotation) are similar in magnitude to each other, and the minimum torque values Vmin are similar in magnitude to each other. Such similarity can be represented by calculated variance values Vmax, Vmin of the maximum and minimum torque values Tmax, Tmin. In this case, Vmax equals $2.0023\times10^{-4}$, and Vmin equals $1.7881\times10^{-4}$. (For clarity, the variance values in FIGS. 4 and 5 are expressed in $\times10^{-4}$.)

FIG. 5 shows an exemplary torque motor current waveform during an entrapment condition. In this case a test was performed by deliberately trapping a sleeve of a shirt between the door 108 and bellows 110. In this case, the maximum motor torque values Tmax and minimum motor torque values Tmin have relatively non-uniform magnitudes. Without being bound by any theory of operation, it is believed that his lack of uniformity can be caused by various factors, such as the trapped article pulling untrapped articles away from the drum or repositioning such untrapped articles to cause changes in the load balance, repositioning of the trapped article at irregular intervals leading to different drag torque loads on the drum 106, and so on. As before, the degree of dispersion of the maximum and minimum motor torque values Tmax, Tmin, is represented by the variance values Vmax and Vmin. In this case, Vmax equals $22.5645\times10^{-4}$, and Vmin equals $22.4579\times10^{-4}$.

In one exemplary embodiment, it was determined via empirical testing that the variance values Vmax, Vmin during normal operation are typically—and almost always—lower than the variance values Vmax, Vmin during an entrapment condition. Table 1 shows a comparison of the maximum variance value Vmax and minimum variance value Vmin during thirty test runs. The first two columns provide Vmax and Vmin values for ten test runs performed with a 5.4 kilogram load of laundry, with a shirt sleeve intentionally trapped between the door 108 and bellows 110. The third and fourth columns provide Vmax and Vmin values for ten test runs performed with a 5.4 kilogram load of laundry, without an entrapment condition. The fifth and sixth columns provide Vmax and Vmin values for ten test runs performed with an 11.3 kilogram load of laundry, without an entrapment condition.

TABLE 1

(variance values are expressed in $\times 10^{-4}$)

| Run | Vmax | Vmin |
|---|---|---|
| 5.4 kg load with entrapment | | |
| 1 | 27.45 | 17.07 |
| 2 | 48.39 | 11.86 |
| 3 | 19.53 | 95.77 |
| 4 | 27.05 | 14.44 |
| 5 | 13.51 | 22.16 |
| 6 | 11.65 | 24.66 |
| 7 | 29.59 | 17.77 |
| 8 | 153.33 | 321.52 |
| 9 | 6.05 | 7.81 |
| 10 | 56.32 | 43.30 |
| 5.4 kg load; no entrapment | | |
| 11 | 1.99 | 1.79 |
| 12 | 1.40 | 1.69 |
| 13 | 0.65 | 0.97 |
| 14 | 1.25 | 1.37 |
| 15 | 0.41 | 1.17 |
| 16 | 1.28 | 1.11 |
| 17 | 0.86 | 1.39 |
| 18 | 0.90 | 2.80 |
| 19 | 0.90 | 1.66 |
| 20 | 2.85 | 2.20 |
| 11.3 kg load; no entrapment | | |
| 21 | 1.86 | 1.11 |
| 22 | 2.04 | 1.78 |
| 23 | 1.33 | 1.02 |
| 24 | 9.18 | 7.12 |
| 25 | 3.70 | 5.26 |
| 26 | 1.32 | 1.08 |
| 27 | 18.62 | 12.00 |
| 28 | 1.50 | 1.74 |
| 29 | 2.30 | 2.48 |
| 30 | 0.79 | 1.78 |

As shown above, the variance values during an entrapment condition were found to be greater than $10\times10^{-4}$ in all but one case (run 9). The variance values without entrapment were found to be less than $10\times10^{-4}$ in all but one case (run 27). Based on this data, setting the predetermined threshold variance value Vt at $10\times10^{-4}$ yields a reasonable expectation of correctly identifying whether or not a load has a shirt sleeve entrapment.

The predetermined threshold variance value Vt also may be selected to bias the system away from either false negative or false positive entrapment determinations. For example, if it is desirable to bias the system away from improperly determining that there is an entrapment condition, the predetermined threshold variance value Vt may be set as $20\times10^{-4}$, which, when applied to the foregoing data set, would yield zero false positives, and only one false negative (run 9). Other alternatives and variations will be apparent to persons of ordinary skill in the art in view of the present disclosure.

It will be understood that further testing could be performed to provide other information to develop a value for the predetermined threshold variance value Vt. For example, larger sample sizes may yield improved data to inform the selection of the desired predetermined threshold variance value Vt. It will also be understood that typical variance values Vmax, Vmin may be determined for different types of entrapment, such as entrapment tests using articles of different sizes (e.g., pant legs, sheets, socks, etc.). The amount and type of testing can vary for each individual type of machine, but it is expected that the determination of useful values of a predetermined threshold variance value Vt can generally be developed without undue experimentation.

The predetermined threshold variance value Vt also may be selected as a dynamic value. For example, the above data indicates a possible relationship between load mass and variance values Vmax, Vmin (i.e., greater variance values for larger loads). Thus, comparative testing of entrapped and non-entrapped loads at different load sizes may provide a basis to modify the predetermined threshold variance value Vt as a function of load mass. In this case, the algorithm 300 may be modified by including a load mass estimation process, and selecting a predetermined threshold variance value Vt based on the estimated mass. For example, the control unit memory **114*b* may include lookup tables containing different predetermined threshold variance values Vt for specific load masses or mass ranges. As another example, the control unit memory 114*b*** may include instructions for scaling a base predetermined threshold variance value Vt according to measured variables such as load mass. Other alternatives and variations will be apparent to persons of ordinary skill in the art in view of the present disclosure.

It will also be understood that variance values Vmax, Vmin are likely to differ depending on the particular configuration and construction of the washing machine 100. However, it is expected that empirical testing of any particular type of washing machine 100 will yield sufficient information about the effect of entrapment on the variance values Vmax, Vmin to establish a useful predetermined threshold variance value Vt.

Figure 3:
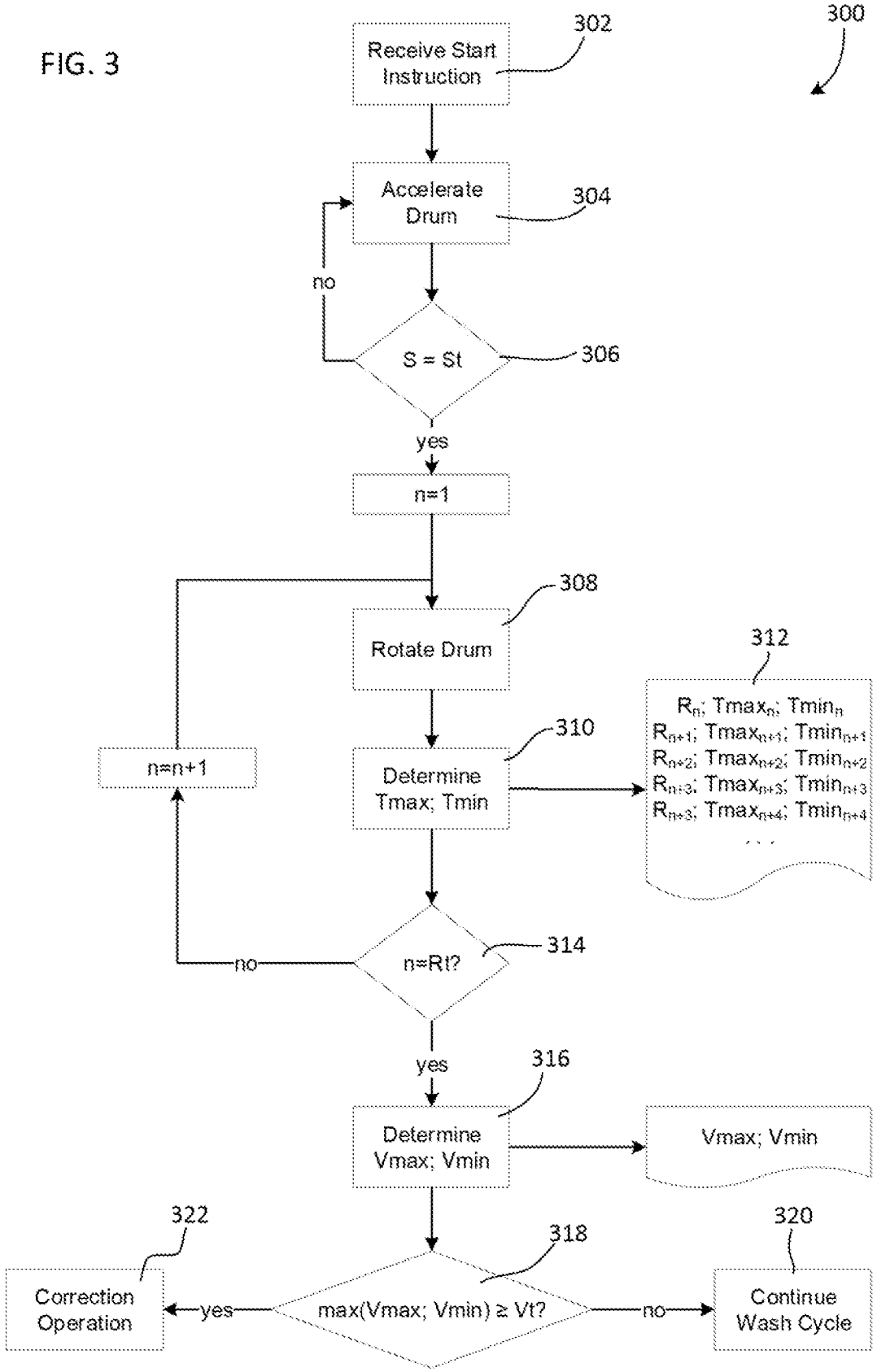
FIG. 3 illustrates an exemplary control algorithm.

Referring back to the algorithm 300 of FIG. 3, the number of rotations R selected for steps 308 and 310 preferably is selected to provide a number of data samples that is sufficient to provide a reliable comparison of the measured variances Vmax, Vmin with the predetermined threshold variance value Vt. A suitable number of rotations R may be determined, for example, by empirical testing. As one example, it has been found that selecting at least ten rotations R is sufficient to provide a useful estimation of the variance values Vmax, Vmin. Furthermore, limiting the number of rotations R (e.g., using exactly ten rotations R) may provide useful results without unduly extending the operation time and increasing the energy consumption of the machine 100.

The example of FIG. 3 collects data and determines a respective variance value Vmax, Vmin for each of the maximum motor torque values Tmax and the minimum motor torque values Tmin, and compares the larger variance value Vmax, Vmin to the predetermined threshold variance value Vt. In other cases, separate predetermined threshold variance values Vt may be determined for comparison to the maximum torque variance value Vmax and the minimum torque variance value Vmin. This may be useful, for example, if empirical testing indicates that the maximum and minimum motor torque values Tmax, Tmin are affected differently by entrapped articles. In addition, it is not strictly necessary to use two motor torque values to evaluate entrapment conditions. For example, if empirical testing indicates that an entrapment condition can be identified by examining only the maximum motor torque value Tmax or only the minimum motor torque value Tmin, then the algorithm 300 may be modified to only consider the maximum torque variance value Vmax or the minimum torque variance value Tmin in relation to the predetermined threshold variance value Vt.

While the foregoing embodiments are described as evaluating motor torque extremum values (i.e., maximum and/or minimum torque values for each rotation R), other embodiments may evaluate and use other kinds of torque value. For example, an embodiment may be configured to integrate the drum motor torque value for each rotation R, and determine a variance of the integrated torque values to compare with a similarly determined predetermined threshold variance value Vt. Other alternatives and variations will be apparent to persons of ordinary skill in the art in view of the present disclosure.

Referring still to FIG. 3, upon determining in step 318 that the collected data indicates that there is no entrapment condition, the control unit 114 moves to step 320 to perform the remainder of the selected washing cycle. The washing cycle may include any of the typical washing cycle phases, including wash liquid loading, agitation (e.g., back and forth motion of the drum 106), wash liquid draining, rinsing, and high-speed spinning. Preferably, no high-speed spinning is performed prior to performing the algorithm 300 (or a version thereof), so that entrapped articles are detected prior to a potentially-damaging high-speed spinning phase.

Upon determining in step 318 that there is a potential entrapment condition, the algorithm 300 performs a correction operation 322. The correction operation 322 can include any process intended to address the entrapment condition. For example, the control unit 114 may simply terminate the wash cycle by operating the drum motor 106 to stop the drum 106 (e.g., via active deceleration or terminating drive power), and/or activate an error indicator via the user interface 116. Such error indicators may include a visual indicator such as a light on a control panel, a message on a remote device, an audible alarm, and so on.

The correction operation 322 also may include one or more verification processes. For example, the rotation counter may be reset, and the process of steps 308 to 318 repeated to re-evaluate whether an entrapment condition may exist. This process may be repeated a third time (or even more times), before finally resorting to terminating the washing cycle if the measured variance fails to drop below the predetermined threshold variance value Vt. Each verification process may evaluate a new set of data for the rotations R performed during the verification process (i.e., ignore the previously-collected torque value measurements Tmax, Tmin and variance values Vmax, Vmin). Alternatively, a verification process may include prior data, such as by incorporating prior torque value measurements Tmax, Tmin in the data set, or comparing newly calculated torque variance values Vmax, Vmin with prior values to determine an average that is compared to the predetermined threshold variance value Vt.

A correction operation 322 also may include a remediation process. For example, upon determining that the greater of the torque variance values Vmax, Vmin exceeds the predetermined threshold variance value Vt, the control unit 114 may operate the drum motor 112 to slow the drum 106 to a rotation speed below the target rotation speed St (e.g., a speed below 100 rpm, or to a stop), and then reaccelerate the drum 106 to the target rotation speed St. The control unit 114 also may operate the drum motor 112 to rotate the drum 106 in reverse for a selected number of rotations to attempt to release an entrapped article. Each verification process may use the same value for the predetermined threshold variance value Vt, but alternatively the predetermined threshold variance value Vt may be changed. For example, in cases in which a remediation process is implemented, the predetermined threshold variance value Vt may be increased for each verification process to bias the machine 100 towards proceeding with the washing cycle. In addition, a correction operation that repeats steps 308 to 318 may alter one or more operating variables, such as the drum rotation speed. Other alternatives and variations will be apparent to persons of ordinary skill in the art in view of the present disclosure.

Various other aspects of the algorithm 300 may be modified. For example, if it is determined during the data collection process of steps 308 to 310 that the drum rotation speed varies from the target rotation speed St, data collected while the drum is below the target rotation speed St may be discarded, or data collected while the drum is above the target rotation speed St may be scaled to correspond to data collected at the target rotation speed St. Alternatively, the data collection process may be restarted completely.

While the embodiments herein are described as being useful to detect an entrapment between the door 108 and bellows 110, it will be appreciated that the methods described herein may also be effective to detect entrapment of an article at other locations within a laundry washing machine. For example, the foregoing methods may be adapted to determine entrapment of an article between a rotating drum and any other non-rotating part (e.g., a ventilation duct opening, a stationary agitator, etc.) that the articles might contact during operation. Furthermore, such methods also may be used to detect entrapped articles in vertical axis laundry washing machines.

The present disclosure describes a number of inventive features and/or combinations of features that may be used alone or in combination with each other or in combination with other technologies. The embodiments described herein are all exemplary, and are not intended to limit the scope of the claims. It will also be appreciated that the inventions described herein can be modified and adapted in various ways, and all such modifications and adaptations are intended to be included in the scope of this disclosure and the appended claims.

The invention claimed is:

1. A method for detecting entrapment of a wash article within a laundry washing machine comprising a tub configured to hold a quantity of wash liquid, a drum rotatably mounted within the tub and configured to hold a quantity of wash articles, a door movable between an open position and a closed position, a bellows seal configured to seal the door to the tub when the door is in the closed position, and a drum motor configured to rotate the drum, the method comprising:

receiving an instruction to begin a laundry washing cycle;

operating the drum motor to accelerate the drum to a target rotation speed; and upon reaching the target rotation speed, performing a first entrapment determination process comprising:

performing a first plurality of rotations at the target rotation speed, determining at least one respective drum motor torque value for each of the first plurality of rotations, determining at least one first distribution characteristic value of the drum motor torque values of the first plurality of rotations, comparing the at least one first distribution characteristic value of the drum motor torque values of the first plurality of rotations to a respective first predetermined threshold value, upon determining that the at least one first distribution characteristic value of the drum motor torque values of the first plurality of rotations is above the respective first predetermined threshold value, performing a correction operation to address an entrapment condition, and upon determining that each at least one first distribution characteristic value of the drum motor torque values of the first plurality of rotations is below the respective first predetermined threshold value, proceeding with the laundry washing cycle.

2. The method of claim 1, wherein the target rotation speed comprises a speed selected to cause satellization of wash articles within the drum.

3. The method of claim 2, wherein the target rotation speed is equal to or greater than 100 rotations per minute.

4. The method of claim 1, wherein the first plurality of rotations comprises at least ten rotations.

5. The method of claim 1, wherein each respective drum motor torque value comprises at least one respective extremum drum motor torque value.

6. The method of claim 5, wherein the at least one respective extremum drum motor torque value comprises a respective maximum motor torque value.

7. The method of claim 5, wherein the at least one respective extremum drum motor torque value comprises a respective minimum motor torque value.

8. The method of claim 5, wherein:

the at least one respective extremum drum motor torque value comprises a respective maximum motor torque value and a respective minimum motor torque value;

determining the at least one first distribution characteristic value of the extremum torque values of the first plurality of rotations comprises determining a single first distribution characteristic value selected as a greater of:

a maximum torque distribution characteristic value of the respective maximum motor torque values of the first plurality of rotations, and a minimum torque distribution characteristic value of the respective minimum motor torque values of the first plurality of rotations; and comparing the at least one first distribution characteristic value of the extremum torque values to the respective first predetermined threshold value comprises comparing the single first distribution characteristic value to a single first predetermined threshold value.

9. The method of claim 5, wherein:

the at least one respective extremum drum motor torque value comprises a respective maximum motor torque value and a respective minimum motor torque value;

determining the at least one first distribution characteristic value of the extremum torque values of the first plurality of rotations comprises determining a maximum torque distribution characteristic value of the respective maximum motor torque values, and determining a minimum torque distribution characteristic value of the respective minimum motor torque values;

comparing the at least one first distribution characteristic value of the extremum torque values of the first plurality of rotations to the respective first predetermined threshold value comprises comparing the maximum torque distribution characteristic value to a predetermined maximum torque distribution characteristic threshold value, and comparing the minimum torque distribution characteristic value to a predetermined minimum torque distribution characteristic threshold value;

determining that the at least one first distribution characteristic value of the extremum torque values of the first plurality of rotations is above the respective first predetermined threshold value comprises determining that one or both of the maximum torque distribution characteristic value is above the predetermined maximum torque distribution characteristic threshold value, and the minimum torque distribution characteristic value is above the predetermined minimum torque distribution characteristic threshold value; and determining that the at least one first distribution characteristic value of the extremum torque values of the first plurality of rotations is below the respective first predetermined threshold value comprises determining that the maximum torque distribution characteristic value is below the predetermined maximum torque distribution characteristic threshold value, and the minimum torque distribution characteristic value is below the predetermined minimum torque distribution characteristic threshold value.

10. The method of claim 1, wherein performing the correction operation to address the entrapment condition comprises operating the drum motor to stop rotation of the drum.

11. The method of claim 1, wherein performing the correction operation to address the entrapment condition comprises:

operating the drum motor to slow the drum below the target rotation speed;

operating the drum motor to accelerate the drum from below the target rotation speed to the target rotation speed; and upon reaching the target rotation speed, performing a second entrapment determination process comprising:

performing a second plurality of rotations at the target rotation speed, determining at least one respective drum motor torque value for each of the second plurality of rotations, determining at least one second distribution characteristic value of the drum motor torque values of the second plurality of rotations, comparing the at least one second distribution characteristic value of the drum motor torque values of the second plurality of rotations to a respective second predetermined threshold value, upon determining that the at least one second distribution characteristic value of the drum motor torque values of the second plurality of rotations is above the respective second predetermined threshold value, performing a further correction operation, and upon determining that each at least one second distribution characteristic value of the drum motor torque values of the second plurality of rotations is below the respective second predetermined threshold value, proceeding with the laundry washing cycle.

12. The method of claim 11, wherein the respective second predetermined threshold value is different from the first respective predetermined value.

13. The method of claim 1, wherein the method further comprises:

estimating a mass of the quantity of wash articles; and determining the first predetermined threshold value as a function of the estimated mass of the quantity of wash articles.

14. The method of claim 1, wherein the at least one first distribution characteristic value comprises a variance value, and determining the at least one variance value of the respective drum motor torque values of the first plurality of rotations comprises:

determining a mean value of the respective drum motor torque values of the first plurality of rotations;

determining a respective difference between each respective drum motor torque value of the first plurality of rotations and the mean value;

squaring the value of each respective difference between each respective drum motor torque value of the first plurality of rotations and the mean value; and averaging a sum of the squared value of each respective difference between each respective drum motor torque value of the first plurality of rotations and the mean value to establish the at least one variance value.

15. The method of claim 1, wherein the at least one first distribution characteristic value comprises one or more of:

a standard deviation value;

a range value;

an interquartile range value; and a confidence interval.

16. The method of claim 1, wherein proceeding with the laundry washing cycle comprises performing a washing phase followed by a high-speed spinning phase.

17. The method of claim 1, wherein operating the drum motor to accelerate the drum to the target rotation speed comprises operating the drum motor to accelerate the drum from a stopped state to the target rotation speed.

18. A method for detecting entrapment of a wash article within a laundry washing machine comprising a tub configured to hold a quantity of wash liquid, a drum rotatably mounted within the tub and configured to hold a quantity of wash articles, a door movable between an open position and a closed position, a bellows seal configured to seal the door to the tub when the door is in the closed position, and a drum motor configured to rotate the drum, the method comprising:

receiving an instruction to begin a laundry washing cycle;

operating the drum motor to accelerate the drum from to a target rotation speed; and upon reaching the target rotation speed, performing a first entrapment determination process comprising:

performing a first plurality of rotations at the target rotation speed, determining a respective maximum motor torque value and a respective minimum motor torque value for each of the first plurality of rotations, determining at maximum torque distribution characteristic value of the respective maximum torque values of the first plurality of rotations, determining at minimum torque distribution characteristic value of the respective minimum torque values of the first plurality of rotations, comparing a greater of the maximum torque distribution characteristic value and the minimum torque distribution characteristic value to a first predetermined threshold value, upon determining that the greater of the maximum torque distribution characteristic value and the minimum torque distribution characteristic value is above the first predetermined threshold value, performing a correction operation to address an entrapment condition, and upon determining that the greater of the maximum torque distribution characteristic value and the minimum torque distribution characteristic value is below the first predetermined threshold value, proceeding with the laundry washing cycle.

19. The method of claim 18, wherein performing the correction operation to address the entrapment condition comprises:

performing a second plurality of rotations at the target rotation speed, determining a respective maximum motor torque value and a respective minimum motor torque value for each of the second plurality of rotations, determining at maximum torque distribution characteristic value of the respective maximum torque values of the second plurality of rotations, determining at minimum torque distribution characteristic value of the respective minimum torque values of the second plurality of rotations, comparing a greater of the maximum torque distribution characteristic value and the minimum torque distribution characteristic value to a second predetermined threshold value, upon determining that the greater of the maximum torque distribution characteristic value and the minimum torque distribution characteristic value is above the second predetermined threshold value, performing a further correction operation, and upon determining that the greater of the maximum torque distribution characteristic value and the minimum torque distribution characteristic value is below the second predetermined threshold value, proceeding with the laundry washing cycle.

20. The method of claim 19, wherein the second predetermined threshold value is the same as the first predetermined threshold value.

21. The method of claim 19, wherein the second predetermined threshold is different from the first predetermined threshold.

22. The method of claim 19, wherein the further correction operation comprises one or both of: operating the drum motor to stop rotation of the drum and displaying an error message on a user interface.

23. The method of claim 19, wherein the further correction operation comprises:

performing a third plurality of rotations at the target rotation speed, determining a respective maximum motor torque value and a respective minimum motor torque value for each of the third plurality of rotations, determining at maximum torque distribution characteristic value of the respective maximum torque values of the third plurality of rotations, determining at minimum torque distribution characteristic value of the respective minimum torque values of the third plurality of rotations, comparing a greater of the maximum torque distribution characteristic value and the minimum torque distribution characteristic value to a third predetermined threshold value, upon determining that the greater of the maximum torque distribution characteristic value and the minimum torque distribution characteristic value is above the third predetermined threshold value, operating the drum motor to stop rotation of the drum and/or displaying an error message on a user interface, and upon determining that the greater of the maximum torque distribution characteristic value and the minimum torque distribution characteristic value is below the third predetermined threshold value, proceeding with the laundry washing cycle.

* * * * *